US011898218B2

(12) United States Patent
Shin et al.

(10) Patent No.: US 11,898,218 B2
(45) Date of Patent: *Feb. 13, 2024

(54) MATERIAL FOR HOT STAMPING AND METHOD FOR MANUFACTURING THE SAME

(71) Applicant: Hyundai Steel Company, Incheon (KR)

(72) Inventors: Nu Ri Shin, Incheon (KR); Hun Chul Kang, Incheon (KR); Ji Hee Son, Incheon (KR); Byoung Hoon Kim, Incheon (KR)

(73) Assignee: Hyundai Steel Company, Incheon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/110,190

(22) Filed: Dec. 2, 2020

(65) Prior Publication Data

US 2022/0064748 A1 Mar. 3, 2022

(30) Foreign Application Priority Data

Sep. 1, 2020 (KR) ..... 10-2020-0111293

(51) Int. Cl.

| | |
|---|---|
| ***C21D 9/46*** | (2006.01) |
| ***B21B 3/00*** | (2006.01) |
| ***C21D 6/00*** | (2006.01) |
| ***C21D 8/02*** | (2006.01) |
| ***C22C 38/00*** | (2006.01) |

(Continued)

(52) U.S. Cl.

CPC ..... *C21D 9/46* (2013.01); *B21B 3/003* (2013.01); *C21D 6/002* (2013.01); *C21D 6/005* (2013.01);

(Continued)

(58) Field of Classification Search

CPC ..... C21D 9/46

See application file for complete search history.

(56) References Cited

U.S. PATENT DOCUMENTS

| | | | | |
|---|---|---|---|---|
| 11,326,226 | B2 * | 5/2022 | Shin | C21D 6/002 |
| 2018/0147614 | A1 | 5/2018 | Roubidoux | |

(Continued)

FOREIGN PATENT DOCUMENTS

| | | |
|---|---|---|
| EP | 2631307 A1 | 8/2013 |
| EP | 2684972 A1 | 1/2014 |

(Continued)

OTHER PUBLICATIONS

NPL: on-line translation of JP 2005029870 A, Feb. 2005 (Year: 2005).*

(Continued)

*Primary Examiner* — Jie Yang

(74) *Attorney, Agent, or Firm* — Fox Rothschild LLP

(57) ABSTRACT

Provided is a material for hot stamping including: a steel sheet including carbon (C) in an amount of 0.28 wt % to 0.50 wt %, silicon (Si) in an amount of 0.15 wt % to 0.70 wt %, manganese (Mn) in an amount of 0.5 wt % to 2.0 wt %, phosphorus (P) in an amount less than or equal to 0.05 wt %, sulfur (S) in an amount less than or equal to 0.01 wt %, chromium (Cr) in an amount of 0.1 wt % to 0.5 wt %, boron (B) in an amount of 0.001 wt % to 0.005 wt %, balance iron (Fe), and other inevitable impurities; and fine precipitates distributed in the steel sheet, wherein the fine precipitates include nitride or carbide of at least one of titanium (Ti), niobium (Nb), and vanadium (V), and trap hydrogen.

3 Claims, 5 Drawing Sheets

(51) Int. Cl.
*C22C 38/02* (2006.01)
*C22C 38/04* (2006.01)
*C22C 38/32* (2006.01)

(52) U.S. Cl.
CPC ..... *C21D 6/008* (2013.01); *C21D 8/0205* (2013.01); *C21D 8/0226* (2013.01); *C22C 38/002* (2013.01); *C22C 38/02* (2013.01); *C22C 38/04* (2013.01); *C22C 38/32* (2013.01); *C21D 2211/004* (2013.01)

(56) References Cited

U.S. PATENT DOCUMENTS

| | | | | |
|---|---|---|---|---|
| 2021/0062313 | A1 | 3/2021 | Seong et al. | |
| 2021/0147955 | A1* | 5/2021 | Yoo ..... | C21D 8/0457 |
| 2022/0025498 | A1 | 1/2022 | Suzuki et al. | |

FOREIGN PATENT DOCUMENTS

| | | | | |
|---|---|---|---|---|
| JP | 2005-029870 | A | | 2/2005 |
| JP | 2005068548 | A | * | 3/2005 |
| KR | 1020110075319 | A | | 7/2011 |
| KR | 10-2017-0076009 | A | | 7/2017 |
| KR | 101848157 | B1 | | 4/2018 |
| KR | 1020180133508 | A | | 12/2018 |
| KR | 101938073 | B1 | | 1/2019 |
| KR | 1020190001226 | A | | 1/2019 |
| KR | 10-2019-0078327 | A | | 7/2019 |
| KR | 102021200 | B1 | | 9/2019 |
| KR | 102031460 | B1 | | 10/2019 |
| KR | 1020200036248 | A | | 4/2020 |
| KR | 102110679 | B1 | | 5/2020 |
| KR | 10-2020-0061922 | A | | 6/2020 |
| WO | 2017203994 | A1 | | 11/2017 |
| WO | 2018096387 | A1 | | 5/2018 |
| WO | 2019132342 | A1 | | 7/2019 |
| WO | 2019186930 | A1 | | 10/2019 |
| WO | 2020/111230 | A1 | | 6/2020 |

OTHER PUBLICATIONS

Office Action dated Feb. 22, 2023 in corresponding Korean Application No. 10-2021-042812.

* cited by examiner

MATERIAL FOR HOT STAMPING AND METHOD FOR MANUFACTURING THE SAME

CROSS-REFERENCE TO RELATED APPLICATION

This application is based on and claims priority under 35 U.S.C. § 119 to Korean Patent Application No. 10-2020-0111293, filed on Sep. 1, 2020, in the Korean Intellectual Property Office, the disclosure of which is incorporated by reference herein in its entirety.

BACKGROUND

1. Field

Exemplary embodiments of the present invention relate to a material for hot stamping and a method of manufacturing the same, and more particularly, to a material for hot stamping, which is capable of providing high-quality mechanical characteristics and hydrogen-delayed fracture characteristics to a hot stamping part, and a method of manufacturing the material.

2. Description of the Related Art

High strength steel is used to manufacture light weight and strong parts for automobiles. High strength steel may provide high strength characteristics compared to the weight thereof. However, as the strength increases, press formability decreases, and thus, a material may break or a spring back phenomenon may occur during a manufacturing process. As a result, it is difficult to precisely form a product having a complex shape.

As a method of addressing these issues, a hot stamping method has been used. As interest in this method increases, research on materials for hot stamping has been actively conducted. For example, as disclosed in the invention of Korean Patent Publication No. 10-2017-0076009, a hot stamping method is a molding technology in which a boron steel sheet is heated to an appropriate temperature, formed in a press mold, and then rapidly cooled to manufacture a high-strength part. According to the invention of Korean Patent Publication No. 10-2017-0076009, cracks, poor shape freezing, or the like occurring in a high-strength steel sheet during forming may be suppressed to thereby manufacture a part with high precision.

However, in the case of a hot stamping steel sheet, hydrogen-delayed fracture occurs due to hydrogen and residual stress introduced in a hot stamping process. In relation to this, Korean Patent Publication No. 10-2020-0061922 discloses that preheating is performed before a hot stamping blank is heated to a high temperature so as to form a thin oxide layer on a surface of the blank, thereby blocking the inflow of hydrogen in a high temperature heating process to reduce hydrogen-delayed fracture. However, since it is impossible to completely block the inflow of hydrogen, introduced hydrogen may not be controlled, thereby leading to hydrogen-delayed fracture.

SUMMARY

One or more embodiments include a material for hot stamping, which is capable of providing high-quality mechanical characteristics and hydrogen-delayed fracture characteristics to a hot stamping part, and a method of manufacturing the material. However, one or more embodiments are only example embodiments, and the scope of the disclosure is not limited by the example embodiments.

According to one aspect, provided is a material for hot stamping including: a steel sheet including carbon (C) in an amount of 0.28 wt % to 0.50 wt %, silicon (Si) in an amount of 0.15 wt % to 0.70 wt %, manganese (Mn) in an amount of 0.5 wt % to 2.0 wt %, phosphorus (P) in an amount less than or equal to 0.05 wt %, sulfur (S) in an amount less than or equal to 0.01 wt %, chromium (Cr) in an amount of 0.1 wt % to 0.5 wt %, boron (B) in an amount of 0.001 wt % to 0.005 wt %, balance iron (Fe), and other inevitable impurities; and fine precipitates distributed in the steel sheet, wherein the fine precipitates include nitride or carbide of at least one of titanium (Ti), niobium (Nb), and vanadium (V), and trap hydrogen.

According an exemplary embodiment, the fine precipitates may be formed greater than or equal to 2,500 pieces and less than or equal to 3,000 pieces per unit area $\mu m^2$.

According an exemplary embodiment, an amount greater than or equal to 90% of the fine precipitates may be formed to have a diameter less than or equal to 0.01 μm.

According an exemplary embodiment, the number of fine precipitates having a diameter less than or equal to 0.01 μm from among the fine precipitates may be greater than or equal to 2,300 and less than or equal to 2,900 per unit area $\mu m^2$.

According an exemplary embodiment, an amount greater than or equal to 60% of the fine precipitates may be formed to have a diameter less than or equal to 0.005 μm.

According an exemplary embodiment, a mean distance between the fine precipitates may be greater than or equal to 0.15 μm and less than or equal to 0.4 μm.

According an exemplary embodiment, the steel sheet may further include an additive in an amount less than or equal to 0.1 wt %, wherein the additive includes at least one of titanium (Ti), niobium (Nb), and vanadium (V).

According to another aspect, provided is a method of manufacturing a material for hot stamping including: reheating a slab at a slab reheating temperature range of 1,180° C. to 1,280° C.; manufacturing a steel sheet by hot rolling the reheated slab at a finishing delivery temperature range of 830° C. to 930° C.; and coiling the steel sheet at a coiling temperature range of 700° C. to 780° C. and forming fine precipitates in the steel sheet, wherein the fine precipitates include nitride or carbide of at least one of titanium (Ti), niobium (Nb), and vanadium (V), and trap hydrogen.

According an exemplary embodiment, the fine precipitates may be formed greater than or equal to 2,500 pieces and less than or equal to 3,000 pieces per unit area ($\mu m^2$).

According an exemplary embodiment, an amount greater than or equal to 90% of the fine precipitates may be formed to have a diameter less than or equal to 0.01 μm.

According an exemplary embodiment, the number of fine precipitates having the diameter less than or equal to 0.01 μm from among the fine precipitates may be greater than or equal to 2,300 and less than or equal to 2,900 per unit area $\mu m^2$.

According an exemplary embodiment, an amount greater than or equal to 60% of the fine precipitates may be formed to have a diameter less than or equal to 0.005 μm.

According an exemplary embodiment, a mean distance between the fine precipitates may be greater than or equal to 0.15 μm and less than or equal to 0.4 μm.

The slab may include carbon (C) in an amount of 0.28 wt % to 0.50 wt %, silicon (Si) in an amount of 0.15 wt % to 0.70 wt %, manganese (Mn) in an amount of 0.5 wt % to 2.0 wt %, phosphorus (P) in an amount less than 0.05 wt %, sulfur (S) in an amount less than 0.01 wt %, chromium (Cr) in an amount of 0.1 wt % to 0.5 wt %, boron (B) in an amount of 0.001 wt % to 0.005 wt %, balance iron (Fe), and other inevitable impurities, and the additive may include at least one of titanium (Ti), niobium (Nb), and vanadium (V).

Other aspects, features, and advantages other than those described above will become apparent from the specific description, claims, and drawings for implementing the following disclosure.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
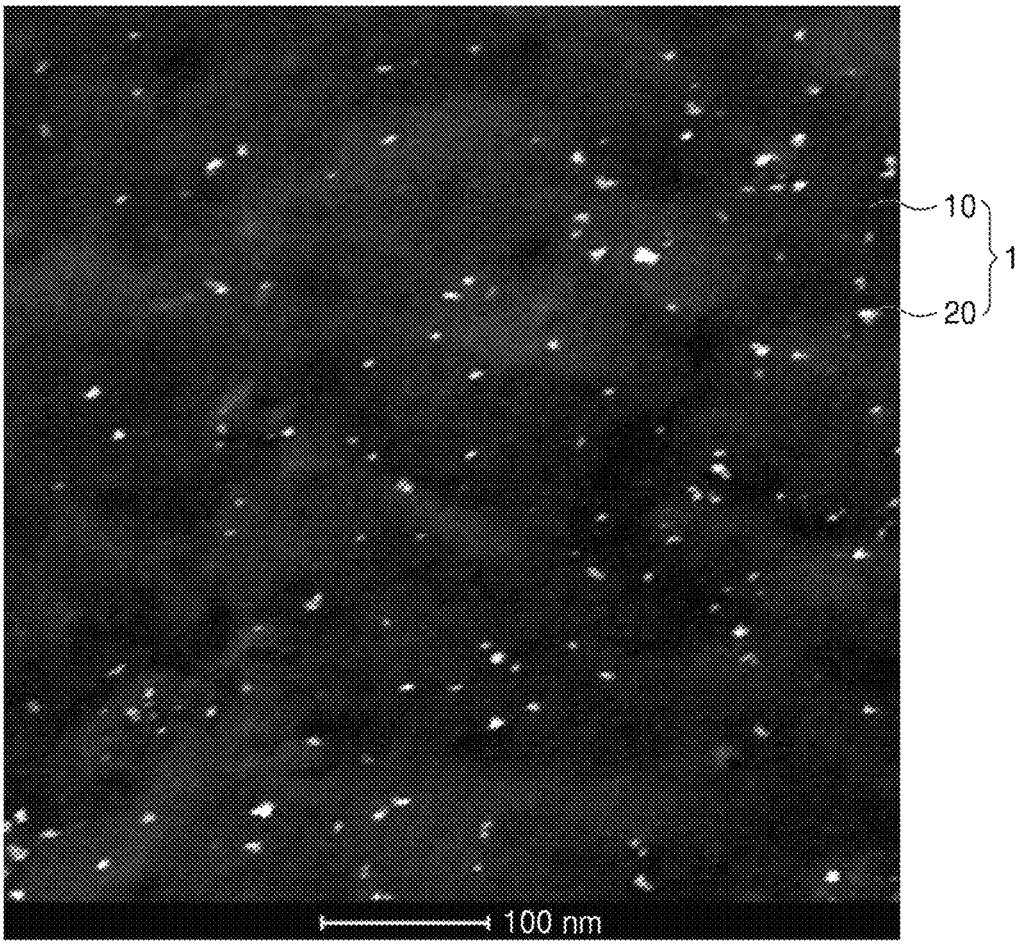
FIG. 1 is a transmission electron microscopy (TEM) image illustrating a portion of a material for hot stamping according to an exemplary embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Hereinafter, exemplary embodiments will be described in detail with reference to the accompanying drawings, and when describing with reference to the drawings, the same or corresponding elements will be given the same reference numerals, and the repeated description thereof will be omitted.

In the following exemplary embodiments, the terms, "first", "second", etc. are only used to distinguish one element from another rather than a limited meaning.

In the following exemplary embodiments, the singular forms are intended to include the plural forms as well, unless the context clearly indicates otherwise.

In the following exemplary embodiments, it will be understood that the terms "comprises," "comprising," "includes," or "including," when used herein, specify the presence of stated features or elements, but do not preclude the presence or addition of one or more other features or elements.

In the following exemplary embodiments, when a layer, area, or element is referred to as being on another layer, area, or element, it may be directly or indirectly on the other layer, area, or element, and an intervening layer, area, or element may be present.

In the drawings, the sizes of elements may be exaggerated or reduced for convenience of description. For example, since the size and thickness of each element shown in the drawings are arbitrarily shown for convenience of description, the disclosure is not necessarily limited to those shown.

When a certain embodiment is capable of being implemented differently, a particular process order may be performed differently from the described order. Two processes described in succession may be performed substantially simultaneously or may be performed in an order opposite to the described order.

In the following exemplary embodiments, it will be understood that when a layer, a region, or an element is referred to as being "connected to" or "coupled to" another element, it may be directly connected or coupled to the other element and/or an intervening element may be present so that the element may be indirectly electrically connected to the other element. For example, when a layer, a region, or an element is referred to as being electrically connected to another element, it may be directly electrically connected to the other element or an intervening element may be present so that the element may be indirectly electrically connected to the other element.

The x axis, y axis, and z axis are not limited to three axes on an orthogonal coordinate system and may be interpreted in a broad sense including the same. For example, the x axis, y axis, and z axis may be orthogonal to each other but may refer to different directions that are not orthogonal to each other.

Hereinafter, exemplary embodiments of the disclosure will be described in detail with the accompanying drawings.

FIG. 1 is a transmission electron microscopy (TEM) image illustrating a portion of a material for hot stamping according to an exemplary embodiment.

As shown in FIG. 1, a material 1 for hot stamping according to an exemplary embodiment may include a steel sheet 10 and fine precipitates 20 distributed in the steel sheet 10.

The steel sheet 10 may be a steel sheet that is manufactured by performing a hot rolling process and/or a cold rolling process on a slab that is cast to include a certain alloy element in a certain content. The steel sheet 10 may include carbon (C), silicon (Si), manganese (Mn), phosphorus (P), sulfur (S), chromium (Cr), boron (B), balance iron (Fe), and other inevitable impurities. In addition, in one embodiment, the steel sheet 10 may further include, as an additive, at least one of titanium (Ti), niobium (Nb), and vanadium (V). In another embodiment, the steel sheet 10 may further include a certain content of calcium (Ca).

Carbon (C) serves as an austenite stabilizing element in the steel sheet 10. Carbon is a major element that determines strength and hardness of the steel sheet 10 and, after a hot stamping process, is added to secure tensile strength of the steel sheet 10 (for example, tensile strength greater than or equal to 1,680 MPa) and secure hardenability characteristics. Carbon as described above may be included in an amount of 0.28 wt % to 0.50 wt % with respect to the total weight of the steel sheet 10. When a content of carbon is less than 0.28 wt %, a hard phase (martensite or the like) may not be secured, and thus, mechanical strength of the steel sheet 10 may not be satisfied. In contrast, when the content of the carbon exceeds 0.50 wt %, brittleness of the steel sheet 10 may occur or a bending performance of the steel sheet 10 may be reduced.

Silicon (Si) serves as a ferrite stabilizing element in the steel sheet 10. Silicon (Si) is a solid solution strengthening element, improves ductility of the steel sheet 10, and suppresses the formation of a low-temperature range carbide, thereby improving carbon concentration in austenite. In addition, silicon is a key element in hot-rolled, cold-rolled, and hot-pressed structure homogenization (perlite, manganese segregation control) and ferrite fine dispersion. Silicon operates as a control element for martensite strength heterogeneity to improve a collision performance. Such silicon may be included in an amount of 0.15 wt % to 0.70 wt % with respect to the total weight of the steel sheet 10. When a content of silicon is less than 0.15 wt %, the above-described effects may not be acquired, cementite may be formed and coarsening may occur in a final hot stamping martensite structure. In addition, a uniformity effect of the steel sheet 10 is insignificant, and a V-bending angle may not be secured. In contrast, when the content of silicon exceeds 0.70 wt %, hot rolling and cold rolling loads may increase, hot rolling red scale may become excessive, and plating characteristics of the steel sheet 10 may deteriorate.

Manganese (Mn) serves as an austenite stabilizing element in the steel sheet 10. Manganese (Mn) is added to increase hardenability and strength during heat treatment. Such manganese may be included in an amount of 0.5 wt % to 2.0 wt % with respect to the total weight of the steel sheet 10. When a content of manganese is less than 0.5 wt %, a grain refinement effect is insufficient, and thus, a hard phase fraction in a formed product may be insufficient after hot stamping due to insufficient hardenability. When the content of manganese exceeds 2.0 wt %, ductility and toughness may be reduced due to manganese segregation or a pearlite band, thereby causing a decrease in the bending performance and generating an inhomogeneous microstructure.

Phosphorus (P) may be included in an amount greater than 0 wt % and less than or equal to 0.05 wt % with respect to the total weight of the steel sheet 10 to prevent a decrease in the toughness of the steel sheet 10. When a content of phosphorus exceeds 0.05 wt %, an iron phosphide compound may be formed to reduce the toughness and weldability, and cracks may be generated in the steel sheet 10 during a manufacturing process.

Sulfur (S) may be included in an amount greater than 0 wt % and less than or equal to 0.01 wt % with respect to the total weight of the steel sheet 10. When a content of sulfur exceeds 0.01 wt %, hot workability, weldability, and impact characteristics may be deteriorated, and a surface detect such as cracks may occur due to formation of a large inclusion.

Chromium (Cr) is added to improve the hardenability and strength of the steel sheet 10. Chromium enables grain refinement and strength to be secured through precipitation hardening. Such chromium may be included in an amount of 0.1 wt % to 0.5 wt % with respect to the total weight of the steel sheet 10. When a content of chromium is less than 0.1 wt %, the precipitation hardening effect is poor. In contrast, when the content of chromium exceeds 0.5 wt %, Cr-based precipitates and matrix solid solution increase, thereby lowering the toughness and increasing raw cost to increase production costs.

Boron (B) is added to secure the hardenability and strength of the steel sheet 10 by securing a martensite structure by suppressing ferrite, pearlite and bainite transformation. Boron segregates at a grain boundary to lower gain boundary energy to thereby increase the hardenability and to increase an austenite grain growth temperature to thereby have the grain refinement effect. Such boron may be included in an amount 0.001 wt % to 0.005 wt % with respect to the total weight of the steel sheet 10. When boron is included in the above range, the occurrence of hard grain boundary brittleness may be prevented, and high toughness and bendability may be secured. When a content of boron is less than 0.001 wt %, a hardenability effect is insufficient. In contrast, when the content of boron exceeds 0.005 wt %, boron has low solid solubility, and thus is easily precipitated at the grain boundary according to heat treatment conditions, thereby deteriorating the hardenability or causing high temperature embrittlement and causing hard grain boundary brittleness to decrease the toughness and bendability.

An additive is an element generating a nitride or carbide generating element that contributes to the formation of the fine precipitates 20. In detail, the additive may include at least one of titanium (Ti), niobium (Nb), and vanadium (V). Titanium (Ti), niobium (Nb), and vanadium (V) secure the strength of a hot stamped and quenched material by forming the fine precipitates 20 in the form of nitride or carbide. In addition, titanium (Ti), niobium (Nb), and vanadium (V) are included in Fe—Mn-based composite oxide, operate as a hydrogen trap site effective for improving delayed fracture resistance characteristics, and are elements for improving the delayed fracture resistance characteristics. Such an additive may be included in a total content less than or equal to 0.1 wt % with respect to the total weight of the steel sheet 10. When a content of the additive exceeds 0.1 wt %, yield strength may excessively increase.

Titanium (Ti) may be added to strengthen hardenability and improve a material by forming precipitates after hot press heat treatment. In addition, titanium (Ti) effectively contributes to refinement of austenite grains by forming a precipitated phase such as Ti (C, N) at a high temperature. Such titanium may be included in an amount of 0.02 wt % to 0.05 wt % with respect to the total weight of the steel sheet 10. When titanium is included in the above content range, poor continuous casting and coarsening of precipitates may be prevented, the physical characteristics of steel may be easily secured, and defects such as the occurrence of cracks in a surface of the steel may be prevented. In contrast, when the content of titanium exceeds 0.05 wt %, precipitates may be coarsened, thereby decreasing elongation and bendability.

Niobium (Nb) and vanadium (V) are added to increase strength and toughness according to a decrease in a martensite packet size. Each of niobium and vanadium may be included in about 0.02 wt % to about 0.05 wt % with respect to the total weight of the steel sheet 10. When niobium and vanadium are included in the above range, steel has a high grain refinement effect in hot rolling and cold rolling processes, the occurrence of cracks in a slab and brittle fracture of a product during may be prevented steel-making/continuous casting, and the generation of steel-making coarse precipitates may be made lowest.

When an additive includes titanium (Ti) and niobium (Nb), titanium (Ti) and niobium (Nb) may be included in a total of about 0.02 wt % to about 0.09 wt % with respect to the total weight of the steel sheet 10 but are not limited thereto.

Calcium (Ca) may be added to control a shape of an inclusion. Such calcium may be included in an amount less than or equal to 0.003 wt % with respect to the total weight of the steel sheet 10.

The fine precipitates 20 may be distributed in the steel sheet 10 to trap hydrogen. In other words, the fine precipitates 20 may improve hydrogen delayed fracture characteristics of a hot stamped product by providing a trap site for hydrogen introduced into the interior during or after manufacturing of the material 1 for hot stamping. In one embodiment, the fine precipitates 20 may include nitride or carbide of an additive. In detail, the fine precipitates 20 may include nitride or carbide of at least one of titanium (Ti), niobium (Nb), and vanadium (V).

A precipitation behavior of the fine precipitates 20 may be controlled by adjusting process conditions. For example, the precipitation behavior such as the number of fine precipitates 20, a mean distance between the fine precipitates 20 or diameters of the fine precipitates 20 may be controlled by adjusting a coiling temperature (CT) range from among the process conditions. The process conditions will be described later in detail with reference to FIG. 3.

In an exemplary embodiment, the number of fine precipitates 20 formed in the steel sheet 10 may be controlled to satisfy a predetermined range. In detail, the fine precipitates 20 may be formed, in the steel sheet 10, in an amount greater than or equal to 2,500 pieces/$\mu m^2$ (250,000 pieces/100 $\mu m^2$) and less than or equal to 3,000 pieces/$\mu m^2$ (300,000 pieces/100 $\mu m^2$). In particular, from among the fine precipitates 20 distributed in the steel sheet 10, fine precipitates having a diameter less than or equal to 0.01 μm may be formed, in the steel sheet 10, in an amount greater than or equal to 2,300 pieces/$\mu m^2$ (230,000 pieces/100 $\mu m^2$) and less than or equal to 2,900 pieces/$\mu m^2$ (290,000 pieces/100 $\mu m^2$).

When the number of formed fine precipitates 20 is within the above-described range, after hot stamping, needed tensile strength (for example, 1,680 MPa) may be secured, and formability or bendability may be improved. For example, when the number of fine precipitates 20 having a diameter less than or equal to 0.01 μm is less than 2,300 pieces/$\mu m^2$ (230,000 pieces/100 $\mu m^2$), the strength may be reduced. In contrast, when the number exceeds 2,900 pieces/$\mu m^2$ (290,000 pieces/100 $\mu m^2$), the formability or bendability may deteriorate.

In another exemplary embodiment, a mean distance between adjacent fine precipitates 20 may be controlled to satisfy a predetermined range. Here, the "mean distance" may refer to a mean free path of the fine precipitates 20, and a method of measuring the mean distance will be described later in detail.

In detail, the mean distance between the fine precipitates 20 may be greater than or equal to 0.15 μm and less than or equal to 0.4 μm. When the mean distance between the fine precipitates 20 is less than 0.15 μm, the formability or bendability may deteriorate. In contrast, when the mean distance between the fine precipitates 20 exceeds 0.4 μm, the strength may be reduced.

In another exemplary embodiment, the diameter of the fine precipitates 20 may be controlled to satisfy a predetermined condition. In detail, an amount greater than or equal to 90% of the fine precipitates 20 formed in the steel sheet 10 may be formed to have a diameter less than or equal to 0.01 μm. Also, an amount greater than or equal to 60% of the fine precipitates 20 formed in the steel sheet 10 may be formed to have a diameter less than or equal to 0.005 μm. In addition, in an alternative embodiment, a mean diameter of the fine precipitates 20 formed in the steel sheet 10 may be less than or equal to 0.006 μm.

The diameter of the fine precipitates 20 described above significantly affects improvement of the hydrogen delayed fracture characteristics. Hereinafter, a difference in the effect of improving the hydrogen delayed fracture characteristics according to the diameter of the fine precipitates 20 will be described with reference to FIGS. 2A and 2B.

Figure 2A:
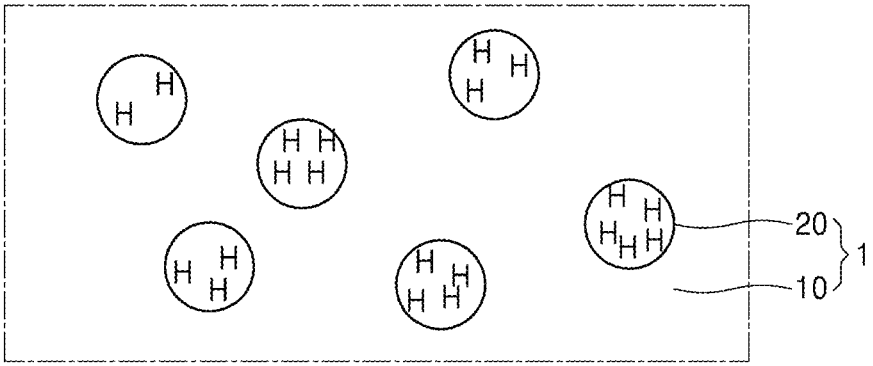
FIGS. 2A and 2B are example views schematically illustrating a portion of a state in which hydrogen is trapped in fine precipitates.
Figure 2B:
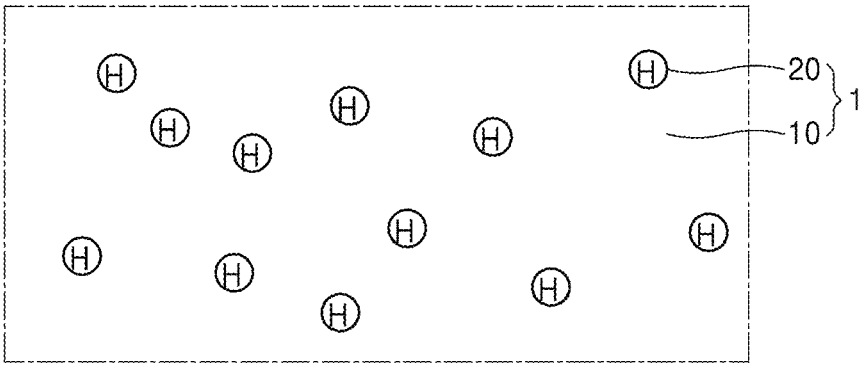

FIGS. 2A and 2B are example views schematically illustrating a portion of a state in which hydrogen is trapped in the fine precipitates 20.

In detail, FIG. 2A illustrates that hydrogen is trapped in the fine precipitates 20 having a relatively great diameter, and FIG. 2B illustrates that hydrogen is trapped in the fine precipitates 20 having a relatively small diameter.

As shown in FIG. 2A, when a diameter of the fine precipitates 20 is relatively great, the number of hydrogen atoms trapped in one fine precipitate 20 increases. In other words, hydrogen atoms introduced into the steel sheet 10 are not evenly dispersed, and the probability of a plurality of hydrogen atoms being trapped in one hydrogen trap site increases. The plurality of hydrogen atoms trapped in the one hydrogen trap site may be combined with one another to form a hydrogen molecule $H_2$. The formed hydrogen molecule may increase the probability of generating internal pressure, and as a result, may deteriorate hydrogen delayed fracture characteristics of a hot stamped product.

In contrast, as shown in FIG. 2B, when the diameter of the fine precipitates 20 is relatively small, the probability of a plurality of hydrogen atoms being trapped in one fine precipitate 20 decreases. In other words, hydrogen atoms introduced into the steel sheet 10 may be trapped in different hydrogen trap sites to be relatively evenly dispersed. Accordingly, the hydrogen atoms may not be combined with one another, and thus, the probability of generating internal pressure may decrease due to a hydrogen molecule, thereby improving hydrogen delayed fracture characteristics of a hot stamped product.

A precipitation behavior of the fine precipitates 20 as described above may be measured by a method of analyzing a transmission electron microscopy (TEM) image. In detail, TEM images for certain areas as many as a predetermined number may be acquired for a specimen. The fine precipitates 20 may be extracted from acquired images through an image analysis program or the like, and the number of fine precipitates 20, a mean distance between the fine precipitates 20, a diameter of the fine precipitates 20, and the like may be measured for the extracted fine precipitates 20.

In one exemplary embodiment, a surface replication method may be applied as pretreatment to a specimen to be measured to measure the precipitation behavior of the fine precipitates 20. For example, a first-stage replica method, a second-stage replica method, an extraction replica method, or the like may be applied but are not limited to the above-described examples.

In another exemplary embodiment, when measuring the diameters of the fine precipitates 20, the diameters of the fine precipitates 20 may be calculated by converting the shapes of the fine precipitates 20 into circles in consideration of the uniformity of the shapes of the fine precipitates 20. In detail, an area of the extracted fine precipitate 20 may be measured by using a unit pixel having a particular area, and the diameter of the fine precipitate 20 may be calculated by converting a shape of the fine precipitate 20 into a circle having the same area as the measured area.

In another embodiment, the mean distance between the fine precipitates 20 may be measured via the mean free path described above. In detail, the mean distance between the fine precipitates 20 may be calculated by using a particle area fraction and the number of particles per unit length. For example, the mean distance between the fine precipitates 20 may have a correlation as in Equation 1 below.

$$\lambda=(1-AA)/NL \quad \text{[Equation 1]}$$

($\lambda$: mean distance between particles, AA: particle area fraction, NL: number of particles per unit length)

A method of measuring the precipitation behavior of the fine precipitates 20 is not limited to the above-described example, and various methods may be applied.

Figure 3:
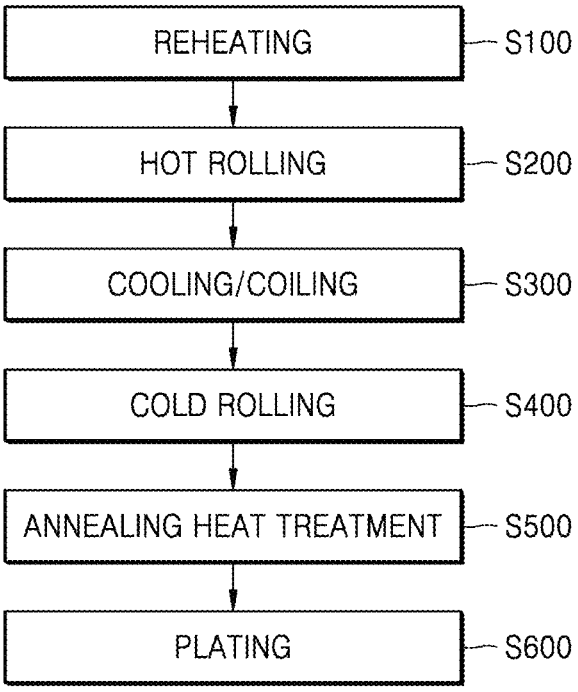
FIG. 3 is a flowchart schematically illustrating a method of manufacturing a material for hot stamping, according to an exemplary embodiment.

FIG. 3 is a flowchart schematically illustrating a method of manufacturing a material for hot stamping, according to one embodiment.

As shown in FIG. 3, a method of manufacturing a material for hot stamping according to an exemplary embodiment may include reheating operation S100, hot rolling operation S200, cooling/coiling operation S300, cold rolling operation S400, annealing heat treatment operation S500, plating operation S600.

For reference, FIG. 3 illustrates that operations S100 through S600 are independent operations. Some of operations S100 through S600 may be performed in one process, and some of operations S100 through S600 may also be omitted as needed.

A slab in a semi-finished product to be subjected to a process of forming the material 1 for hot stamping is provided. The slab may include carbon (C) in an amount of 0.28 wt % to 0.50 wt %, silicon (Si) in an amount of 0.15 wt % to 0.70 wt %, manganese (Mn) in an amount of 0.5 wt % to 2.0 wt %, phosphorus (P) in an amount less than or equal to 0.05 wt %, sulfur (S) in an amount less than or equal to 0.01 wt %, chromium (Cr) in an amount of 0.1 wt % to 0.5 wt %, boron (B) in an amount of 0.001 wt % to 0.005 wt %, balance iron (Fe), and other inevitable impurities. In addition, the slab may further include an additive in total less than or equal to 0.1 wt %. Here, the additive may include at least one of titanium (Ti), niobium (Nb), and vanadium (V). For example, a content of each of titanium (Ti), niobium (Nb), and/or vanadium (V) may be an amount of 0.02 wt % to 0.05 wt %.

Reheating operation S100 is an operation of reheating the slab for hot rolling. In reheating operation S100, components segregated during casting are resolved by reheating, within a certain temperature range, the slab secured through a continuous casting process.

A slab reheating temperature (SRT) may be controlled within a predetermined temperature range to significantly improve austenite refinement and a precipitation hardening effect. Here, a range of the slab reheating temperature (SRT) may be included in a temperature range (about 1,000° C.) in which an additive (Ti, Nb, and/or V) is fully resolved on the basis of an equilibrium precipitation amount of the fine precipitates 20 when reheating the slab. When the slab reheating temperature (SRT) is less than the temperature range in which the additive (Ti, Nb, and/or V) is fully resolved, a driving force needed for microstructure control is not sufficiently reflected during hot rolling, and thus, an effect of securing high-quality mechanical characteristics through needed precipitation control may not be obtained.

In one exemplary embodiment, the slab reheating temperature (SRT) may be controlled about a temperature of 1,180° C. to 1,280° C. When the slab reheating temperature (SRT) is less than 1,180° C., the components segregated during casting are not sufficiently resolved, and thus, a homogenization effect of an alloy element may not be significantly shown, and a solid solution effect of titanium (Ti) may not be significantly shown. In contrast, when the slab reheating temperature (SRT) is high, the slab reheating temperature (SRT) is favorable for homogenization. When the slab reheating temperature (SRT) exceeds 1,280° C., an austenite grain size increases, and thus, the strength may not be secured, and only a manufacturing cost of a steel sheet may increase due to an excessive heating process.

Hot rolling operation S200 is an operation of manufacturing a steel sheet by hot rolling the slab reheated in operation S100 within a range of a certain finishing delivery temperature (FDT). In one exemplary embodiment, the range of the finishing delivery temperature (FDT) may be controlled to a temperature of 830° C. to 930° C. When the finishing delivery temperature (FDT) is less than 830° C., the workability of the steel sheet may not be secured due to the occurrence of a duplex grain structure due to rolling over an abnormal area. Also, the workability may deteriorate due to the microstructure unevenness, and a passing ability may occur during hot rolling due to a rapid phase change. In contrast, when the finishing delivery temperature (FDT) exceeds 930° C., austenite grains are coarsened. In addition, TiC precipitates are coarsened, and thus, the performance of a final part may deteriorate.

In reheating operation S100 and hot rolling operation S200, some of the fine precipitates 20 may be precipitated at grain boundaries at which energy is unstable. Here, the fine precipitates 20 precipitated at the grain boundaries operate as factors that interfere with the growth of austenite grains, thereby providing an effect of enhancing the strength through austenite refinement. The fine precipitates 20 precipitated in operations S100 and S200 may be at a level of 0.027 wt % on the basis of the equilibrium precipitation amount but are not limited thereto.

Cooling/coiling operation S300 is an operation of cooling and coiling the steel sheet hot-rolled in operation S200 in a range of a certain coiling temperature (CT) and forming the fine precipitates 20 in the steel sheet. In other words, in operation S300, the fine precipitates 20 are formed by forming nitride or carbide of the additive (Ti, Nb, and/or V) included in the slab. Coiling may be performed in a ferrite zone so that the equilibrium precipitation amount of the fine precipitates 20 reaches the greatest value. After grain recrystallization is completed as described above, when a structure is transformed into ferrite, the particle size of the fine precipitates 20 may be uniformly precipitated not only at the grain boundary but also in the grain.

In one exemplary embodiment, the coiling temperature (CT) may be a temperature of 700° C. to 780° C. The coiling temperature (CT) affects redistribution of carbon (C). When the coiling temperature (CT) is less than 700° C., a low temperature phase fraction may increase due to subcooling, and thus, the strength may increase, a rolling load may increase during cold rolling, and ductility may rapidly decrease. In contrast, when the coiling temperature (CT) exceeds 780° C., formability and strength may deteriorate due to abnormal grain growth or excessive grain growth.

According to the exemplary embodiments as described above, the precipitation behavior of the fine precipitates 20 may be controlled by controlling the range of the coiling temperature CT. An experimental example for a change in characteristics of the material 1 for hot stamping according to the range of the coiling temperature (CT) will be described later with reference to FIGS. 4, 5A, and 5B.

Cold rolling operation S400 is an operation of uncoiling the steel sheet coiled in operation S300 to pickle the steel sheet, and then cold rolling the steel sheet. Here, pickling is performed to remove scale of the coiled steel sheet, that is, a hot-rolled coil manufactured through the hot rolling process described above. In one exemplary embodiment, during cold rolling, a reduction ratio may be controlled to 30% to 70% but is not limited thereto.

Annealing heat treatment operation S500 is an operation of performing annealing heat treatment on the steel sheet cold rolled in operation S400 at a temperature higher than or equal to 700° C. In one exemplary embodiment, annealing heat treatment includes an operation of heating a cold-rolled sheet material and cooling the heated cold-rolled sheet material at a certain cooling rate.

Plating operation S600 is an operation of forming a plating layer on the annealing heat-treated steel sheet. In one embodiment, in plating operation S600, an Al—Si plating layer may be formed on the steel sheet annealing heat-treated in operation S500.

In detail, plating operation S600 may include: an operation of forming a hot-dip plating layer on a surface of the steel sheet by immersing the steel sheet in a plating bath having a temperature of 650° C. to 700° C.; and a cooling operation of forming a plating layer by cooling the steel sheet on which the hot-dip plating layer is formed. Here, the plating bath may include, as an additional element, Si, Fe, Al, Mn, Cr, Mg, Ti, Zn, Sb, Sn, Cu, Ni, Co, In, Bi, or the like but is not limited thereto.

A hot stamping part satisfying needed strength and bendability may be manufactured by performing a hot stamping process on the material 1 for hot stamping that is manufactured through operations S100 through S600 as described above. In one embodiment, the material 1 for hot stamping manufactured to satisfy the above-described content conditions and process conditions may have tensile strength greater than or equal to 1,680 MPa and bendability greater than or equal to 400 after undergoing the hot stamping process.

Hereinafter, the disclosure will be described in more detail through an embodiment and a comparative example. However, the following embodiment and comparative example are intended to more specifically illustrate the disclosure, and the scope of the disclosure is not limited by the following embodiment and comparative example. The following embodiment and comparative example may be appropriately modified and changed by one of ordinary skill in the art within the scope of the disclosure.

Figure 4:
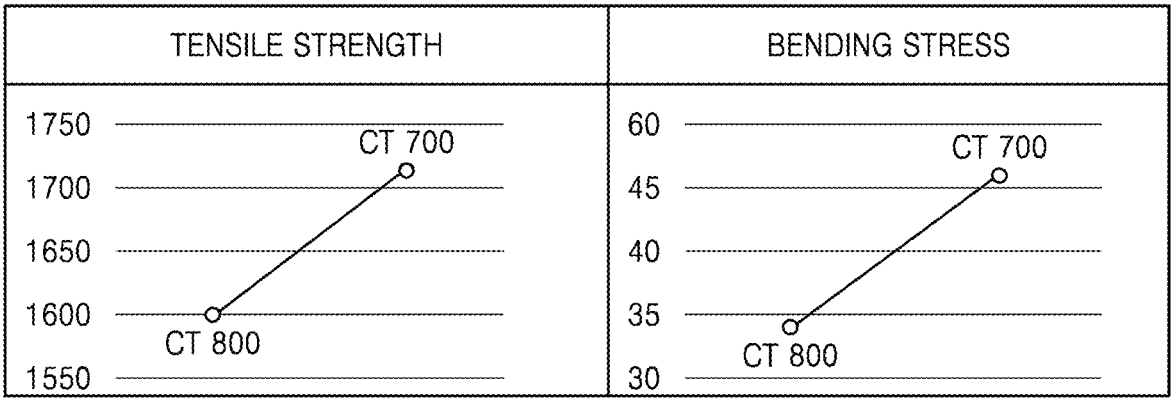
FIG. 4 is a graph illustrating a comparison of tensile strength and bending stress of an exemplary embodiment of the disclosure and a comparative example according to a coiling temperature.
Figure 5A:
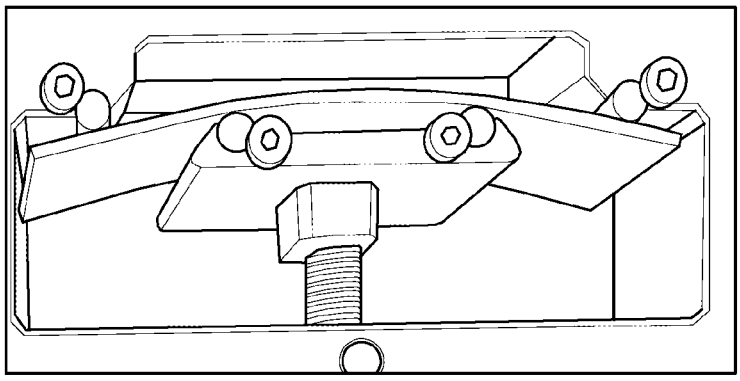
FIGS. 5A and 5B are images illustrating results of a 4-point bending test for an exemplary embodiment and a comparative example according to a coiling temperature.
Figure 5B:
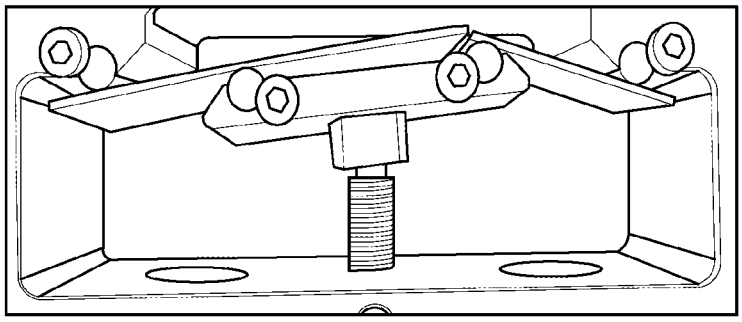

FIG. 4 is a graph illustrating a comparison of tensile strength and bending stress of an embodiment and a comparative example according to a coiling temperature. FIGS. 5A and 5B are images showing results of a 4-point bending test of an embodiment and a comparative example according to a coiling temperature.

An embodiment CT 700 and a comparative example CT 800 are specimens that are manufactured by hot stamping the material 1 for hot stamping manufactured by performing operations S100 through S600 on the slab having a composition as shown in Table 1 below. Here, the embodiment CT 700 and the comparative example CT 800 are specimens that are manufactured by applying the same content conditions and process conditions in a process of manufacturing the material 1 for hot stamping but differentially applying only the coiling temperature (CT) as a variable.

TABLE 1

| components (wt %) | | | | | | | |
|---|---|---|---|---|---|---|---|
| C | Si | Mn | P | S | Cr | B | Additive |
| 0.28~0.50 | 0.15~0.70 | 0.5~2.0 | less than or equal to 0.05 | less than or equal to 0.01 | 0.1~0.5 | 0.001~0.005 | less than or equal to 0.1 |

In detail, the embodiment CT 700 is a specimen that was manufactured by hot stamping the material 1 for hot stamping manufactured by applying the coiling temperature CT of 700° C., and the comparative example CT 800 is a specimen that was manufactured by hot stamping the material 1 for hot stamping manufactured by applying the coiling temperature (CT) of 800° C.

FIG. 4 is a graph showing tensile strength and bending stress measured in the embodiment CT 700 and the comparative example CT 800.

Referring to FIG. 4, in the case of tensile strength, the tensile strength of the embodiment CT 700 was greater than the tensile strength of the comparative example CT 800. Even in the case of bending stress affecting impact characteristics, the bending stress of the embodiment CT 700 was improved compared to the bending stress of the comparative stress CT 800.

This is because, as shown in Table 2 below, in the case of the embodiment CT 700, a precipitation amount of the fine precipitates 20 increased and a hydrogen trapping ability was improved accordingly compared to the comparative example CT 800.

Table 2 below shows measured values of an equilibrium precipitation amount and an amount of activated hydrogen of the embodiment CT 700 and the comparative example CT 800, and results of a bent-beam stress corrosion test on the embodiment CT 700 and the comparative example CT 800. Here, the equilibrium precipitation amount refers to the greatest number of precipitates that may be precipitated when equilibrium is achieved thermodynamically, and, as the equilibrium precipitation amount is great, the number of precipitated precipitates increases. Also, the amount of activated hydrogen refers to an amount of hydrogen excluding hydrogen trapped in the fine precipitates 20 from among hydrogen introduced into the steel sheet 10.

The amount of activated hydrogen as described above may be measured by a thermal desorption spectroscopy method. In detail, while heating a specimen at a predetermined heating rate to raise a temperature, an amount of hydrogen released from the specimen at a temperature lower than or equal to a particular temperature may be measured. Here, hydrogen released from the specimen at the temperature lower than or equal to the particular temperature may be understood as activated hydrogen that are not trapped and affect hydrogen delayed fracture, from among hydrogen introduced into the specimen.

TABLE 2

| sample name | equilibrium precipitation amount (wt %) | result of 4-point bending test | amount of activated hydrogen (wppm) |
|---|---|---|---|
| CT 700 | 0.040 | nonfracture | 0.453 |
| CT 800 | 0.029 | fracture | 0.550 |

Table 2 above shows results of the 4-point bending test that was performed on samples respectively having different equilibrium precipitation amounts of fine precipitates and amounts of activated hydrogen measured by using the thermal desorption spectroscopy method.

Here, the 4-point bending test refers to a test method of checking whether or not a stress corrosion crack occurs while applying, to a specimen manufactured by reproducing a state of exposing the specimen to a corrosive environment, stress at a level lower than or equal to an elastic limit at a particular point. Here, the stress corrosion crack refers to a crack occurring when corrosion and continuous tensile stress act simultaneously.

In detail, the results of the 4-point bending test in Table 2 are the results of checking whether or not fracture occurs by applying, to each of the samples, stress of 1,200 MPa for 100 hours in air. In addition, the amounts of activated hydrogen were measured by using the thermal desorption spectroscopy method and were values obtained by measuring an amount of hydrogen released from the specimen at a temperature less than or equal to 350° C. while raising a temperature from room temperature to 500° C. at a heating rate of 20° C./min for each of the samples.

Referring to Table 2 above, in the case of the equilibrium precipitation amount of the fine precipitates 20, the equilibrium precipitation amount of the embodiment CT 700 was measured as 0.040 wt %, and the equilibrium precipitation amount of the comparative example CT 800 was measured as 0.029 wt %. In other words, the embodiment CT 700 may provide more hydrogen trap sites by forming more fine precipitates 20 compared to the comparative example CT 800.

In the case of the result of the 4-point bending test, the embodiment CT 700 was not fractured, and the comparative example CT 800 was fractured. In addition, in the case of the amount of activated hydrogen, the amount of activated hydrogen of the embodiment CT 700 was measured as about 0.453 wppm, and the amount of activated hydrogen of the comparative example CT 80 was measured as about 0.550 wppm. In this regard, the embodiment CT 700 having a relatively lower amount of activated hydrogen was not fractured, and the comparative example CT 800 having a relatively higher amount of activated hydrogen was fractured. This may be understood that the embodiment CT 700 had improved hydrogen delayed fracture characteristics compared to the comparative example CT 800.

In other words, in the embodiment CT 700, a precipitation amount of fine precipitates 20 increases compared to the comparative example CT 800, and accordingly, the amount of activated hydrogen decreases. This indicates that the amount of hydrogen trapped in the embodiment CT 700 increases compared to the comparative example CT 800, and as a result, may be understood that the hydrogen delayed fracture characteristics are improved.

FIGS. 5A and 5B are images respectively showing results of performing a 4-point bending test on the embodiment CT 700 and the comparative example CT 800.

In detail, FIG. 5A shows a result of performing a 4-point bending test on the exemplary embodiment CT 700, and FIG. 5B corresponds to a result of performing the 4-point bending test on the comparative example CT 800 by applying the same conditions as in the embodiment CT 700.

As shown in FIGS. 5A and 5B, while in the case of the embodiment CT 700, a specimen was not fractured as a result of the 4-point bending test, in the case of the comparative example CT 800, a specimen was fractured.

This indicates that the embodiment CT 700 of FIG. 5A was a specimen manufactured by hot stamping the material 1 for hot stamping manufactured by applying a coiling temperature (CT) of 700° C., wherein fine precipitates 20 having a diameter less than or equal to 0.01 μm were formed in the number greater than or equal to 2,300 and less than or equal to 2,900 per unit area $\mu m^2$, and a mean distance between the fine precipitates 20 satisfied greater than or equal to 0.15 μm and less than or equal to 0.4 μm. Accordingly, in the embodiment CT 700, hydrogen delayed fracture characteristics were improved by efficiently dispersing and trapping hydrogen introduced into the steel sheet 10, and tensile strength and bending characteristics were improved.

In contrast, the comparative example CT 800 of FIG. 5B was a specimen manufactured by hot stamping the material 1 for hot stamping manufactured by applying a coiling temperature of 800° C., wherein the precipitation amount of the fine precipitates 20 was insufficient, and a diameter of the fine precipitates 20 was coarsened, thereby increasing the probability of generating internal pressure due to hydrogen bonding. Accordingly, in the comparative example CT 800, hydrogen introduced into the steel sheet 10 was not efficiently dispersed and trapped, and tensile strength, bending characteristics, and hydrogen delayed fracture characteristics deteriorate.

In other words, although the material 1 for hot stamping is made of the same components, due to a difference in a coiling temperature (CT), differences occur in strength, bendability, and hydrogen delayed fracture characteristics of the material 1 for hot stamping after a hot stamping process. This is because a difference occurs in the precipitation behavior of the fine precipitates 20 according to the coiling temperature (CT). Therefore, when content conditions and process conditions according to the above-described embodiments are applied, high strength may be secured, and bendability and hydrogen delayed fracture characteristics may be improved.

Table 3 below shows, for a plurality of specimens, numerical representations of tensile strength, bendability, and hydrogen delayed fracture characteristics according to a difference in a precipitation behavior of fine precipitates 20. In detail, Table 3 shows, for the plurality of specimens, measured values of the precipitation behavior (the number of fine precipitates 20, a mean distance between the fine precipitates 20, a diameter of the fine precipitates 20, and the like) and measured values of characteristics (tensile strength, bendability, and an amount of activated hydrogen) after hot stamping.

Each of the plurality of specimens is heated to a temperature higher than or equal to Ac3 (a temperature at which transformation from ferrite to austenite is completed) and cooled to a temperature less than or equal to 300° C. at a cooling rate higher than or equal to 30° C./s, and then tensile strength, bendability, and an amount of activated hydrogen are measured.

Here, the tensile strength and the amount of activated hydrogen are measured on the basis of the 4-point bending test and the thermal desorption spectroscopy method described above, and the bendability is obtained by measuring V-bending angle according to VDA238-100 which is the standard of Verband Der Automobilindustrie (VDA).

Also, the precipitation behavior of fine precipitates (the number of fine precipitates, the mean distance between the fine precipitates, the diameter of the fine precipitates, and the like) was measured through TEM image analysis as described above. In addition, the precipitation behavior of the fine precipitates was measured by measuring a precipitation behavior of fine precipitates for certain regions having an area of 0.5 μm*0.5 μm and converting the precipitation behavior on the basis of a unit area (100 $\mu m^2$).

TABLE 3

| specimen | total number of fine precipitates (piece/100 μm²) | diameter less than or equal to 10 nm fine precipitates/ number (piece/100 μm²)/ ratio (%) | total fine precipitates mean distance (μm) | diameter less than or equal to 5 nm fine precipitates/ number (piece/100 μm²)/ ratio (%) | total fine precipitates mean diameter (μm) | after hot stamping tensile strength (MPa) | after hot stamping bendability (°) | after hot stamping amount of activated hydrogen (wppm) |
|---|---|---|---|---|---|---|---|---|
| A | 255,112 | 230,111/90.2% | 0.31 | 150,399/60.0% | 0.0057 | 1708 | 42 | 0.494 |
| B | 250,119 | 244,116/97.6% | 0.28 | 232,361/92.9% | 0.0041 | 1695 | 42 | 0.497 |
| C | 281,600 | 279,600/99.4% | 0.18 | 198,000/70.1% | 0.0044 | 1741 | 46 | 0.453 |
| D | 288,750 | 288,125/99.8% | 0.18 | 244,375/84.6% | 0.0042 | 1750 | 44 | 0.448 |
| E | 275,826 | 261,483/94.8% | 0.19 | 207,145/75.1% | 0.0047 | 1745 | 48 | 0.455 |
| F | 299,981 | 269,983/90.0% | 0.16 | 182,688/60.9% | 0.0053 | 1756 | 50 | 0.471 |
| G | 299,269 | 289,992/96.9% | 0.15 | 182,554/61.0% | 0.0046 | 1757 | 46 | 0.422 |
| H | 298,554 | 283,925/95.1% | 0.15 | 252,278/84.5% | 0.0038 | 1750 | 44 | 0.425 |
| I | 261,769 | 243,969/93.2% | 0.40 | 159,941/61.1% | 0.0056 | 1715 | 42 | 0.491 |
| J | 278,002 | 273,554/98.4% | 0.20 | 215,730/77.6% | 0.006 | 1736 | 55 | 0.458 |
| K | 255,252 | 229,982/90.1% | 0.35 | 155,448/60.9% | 0.0055 | 1671 | 45 | 0.452 |
| L | 249,991 | 228,742/91.5% | 0.37 | 151,995/60.8% | 0.0051 | 1664 | 50 | 0.495 |
| M | 292,981 | 290,051/99.0% | 0.16 | 214,462/73.2% | 0.0039 | 1752 | 37 | 0.457 |
| N | 300,093 | 279,687/93.2% | 0.16 | 179,093/62.8% | 0.0049 | 1764 | 35 | 0.481 |
| O | 274,850 | 260,283/94.7% | 0.23 | 169,033/61.5% | 0.0071 | 1678 | 42 | 0.505 |
| P | 299,566 | 269,010/89.8% | 0.17 | 254,032/84.8% | 0.0042 | 1742 | 40 | 0.514 |
| Q | 250,228 | 239,969/95.9% | 0.32 | 149,887/59.9% | 0.0058 | 1712 | 51 | 0.502 |
| R | 299,989 | 156,913/95.1% | 0.37 | 179,093/59.7% | 0.0051 | 1755 | 43 | 0.504 |
| S | 299,853 | 289,958/96.7% | 0.14 | 284,261/94.8% | 0.0036 | 1753 | 38 | 0.438 |
| T | 242,154 | 219,392/90.6% | 0.41 | 145,777/60.2% | 0.0059 | 1678 | 44 | 0.498 |

Table 3 above shows, for specimens A through T, measured values of a precipitation behavior of fine precipitates (the number of fine precipitates, a mean distance between the fine precipitates, a diameter of the fine precipitates, and the like) and measured values of characteristics (tensile strength, bendability, and an amount of activated hydrogen) after hot stamping.

The specimens A through J in Table 3 above are specimens that were manufactured by hot stamping the material 1 for hot stamping manufactured through operations S100 through S600 by applying the above-described process conditions to a slab satisfying the above-described content conditions (refer to Table 1). In other words, the specimens A through J are specimens that satisfy precipitation behavior conditions of the fine precipitates 20 described above. In detail, the specimens A through J satisfied the precipitation behavior conditions in which the fine precipitates 20 were formed, in the steel sheet 10, greater than or equal to 2,500 pieces/μm² (250,000 pieces/100 μm²) and less than or equal to 3,000 pieces/μm² (300,000 pieces/100 μm²), a mean diameter of all fine precipitates was less than or equal to 0.006 μm, greater than or equal to 90% of the fine precipitates 20 formed in the steel sheet 10 had a diameter less than or equal to 0.01 μm, greater than or equal to 60% of the fine precipitates 20 had a diameter less than or equal to 0.005 μm, and a mean distance between the fine precipitates 20 was greater than or equal to 0.15 μm and less than or equal to 0.4 μm.

The specimens A through J of the disclosure satisfying the precipitation behavior conditions as described above had improved tensile strength, bendability, and hydrogen delayed fracture characteristics. In detail, in the specimens A through J, tensile strength satisfied greater than or equal to 1,680 MPa after hot stamping, bendability satisfied greater than or equal to 400 after hot stamping, and an amount of activated hydrogen satisfied less than or equal to 0.5 wppm after hot stamping.

In contrast, specimens K through T are specimens that did not satisfy at least some of the precipitation behavior conditions of the fine precipitates described above and had lower tensile strength, bendability, and/or hydrogen delayed fracture characteristic than the specimens A through J.

In the case of the specimen K, the number of fine precipitates having a diameter less than or equal to 10 nm was 229,982. This is less than the lower limit of the condition of the number of fine precipitates having a diameter less than or equal to 10 nm. Accordingly, the tensile strength of the specimen was is only 1,671 Mpa, which is relatively low.

In the case of the specimen L, the number of all fine precipitates as 249,991. This is less than the lower limit of the condition of the number of all fine precipitates. Therefore, the tensile strength of the specimen L was only 1,664 Mpa, which is relatively low.

In the case of the specimen M, the number of fine precipitates having a diameter less than or equal to 10 nm was 290,051. This exceeds the upper limit of the condition of the number of fine precipitates having a diameter less than or equal to 10 nm. Accordingly, the bendability of the specimen M was only 37°, which is relatively low.

In the case of the specimen N, the number of all fine precipitates was 300,093. This exceeds the upper limit of the condition of the number of all fine precipitates. Therefore, the bendability of the specimen N was only 35°, which is relatively low.

In the case of the specimen O, a mean diameter of all fine precipitates was 0.0071 μm. This exceeds the upper limit of a mean diameter condition of all fine precipitates. Accordingly, an amount of activated hydrogen in the specimen O was measured as 0.505 wppm, which is relatively high, and thus, hydrogen delayed fracture characteristics deteriorated relatively.

In the case of the specimen P, a ratio of fine precipitates having a diameter less than or equal to 10 nm was 89.8%. This is less than the lower limit a ratio condition of fine precipitates having a diameter less than or equal to 5 nm. Accordingly, an amount of activated hydrogen in the specimen P was measured as 0.514 wppm, which is relatively high, and thus, hydrogen delayed fracture characteristics deteriorated relatively.

In the case of the specimen Q, a ratio of fine precipitates having a diameter less than or equal to 5 nm was 59.9%. This is less than the lower limit of the ratio condition of the fine precipitates having the diameter less than or equal to 5 nm. Therefore, an amount of activated hydrogen in the specimen Q was measured as 0.502 wppm, which is relatively high, and thus, hydrogen delayed fracture characteristics deteriorated relatively.

In the case of the specimen R, a ratio of fine precipitates having a diameter less than or equal to 5 nm was 59.7%. This is less than the lower limit of the ratio condition of the fine precipitates having the diameter less than or equal to 5 nm. Accordingly, an amount of activated hydrogen in the specimen R was measured as 0.504 wppm, which is relatively high, and thus, hydrogen delayed fracture characteristics deteriorated relatively.

In the case of the specimen S, a mean distance of all fine precipitates was 0.14 μm. This is less than the lower limit of a mean distance condition of all fine precipitates. Accordingly, the bendability of the specimen S was only 38°, which is relatively low.

In the case of the specimen T, a mean distance of all fine precipitates was 0.41 μm. This exceeds the upper limit of the mean distance condition of all fine precipitates. Accordingly, the tensile strength of the specimen T was only 1,678 Mpa, which is relatively low.

As a result, the material 1 for hot stamping that was manufactured in a method of manufacturing a material for hot stamping by applying the content conditions and the process conditions of the disclosure described above satisfied the precipitation behavior condition of the fine precipitates described above after hot stamping. A hot stamped product satisfying the precipitation behavior condition of the fine precipitates 20 as described above had improved tensile strength, bendability, and hydrogen delayed fracture characteristics.

According to exemplary embodiments of the disclosure, a material for hot stamping capable of securing high-quality mechanical characteristics and hydrogen delayed fracture characteristics of a hot stamping part, and a method of manufacturing the material for hot stamping may be implemented. The scope of the disclosure is not limited by these effects.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A method of manufacturing a material for hot stamping, the method comprising:

reheating a slab at a slab reheating temperature range of 1,180° C. to 1,280° C.;

manufacturing a steel sheet by hot rolling the reheated slab at a finishing delivery temperature range of 830° C. to 930° C.; and coiling the steel sheet at a coiling temperature range of greater than 700° C. and less than or equal to 780° C. and forming fine precipitates in the steel sheet, uncoiling the coiled steel sheet and then cold rolling the steel sheet, and performing annealing heat treatment on the cold rolled steel sheet at a temperature greater than or equal to 700° C., and forming a plating layer on the annealing heat-treated steel sheet by immersing the steel sheet in a plating bath having a temperature of about 650° C. to about 700° C., wherein the fine precipitates include nitride or carbide of at least one of titanium (Ti), niobium (Nb), and vanadium (V), and trap hydrogen, wherein the slab comprises carbon (C) in an amount of 0.32 wt % to 0.50 wt %, silicon (Si) in an amount of 0.15 wt % to 0.70 wt %, manganese (Mn) in an amount of 0.5 wt % to 2.0 wt %, phosphorus (P) in an amount less than 0.05 wt %, sulfur (S) in an amount less than 0.01 wt %, chromium (Cr) in an amount of 0.1 wt % to 0.5 wt %, boron (B) in an amount of 0.001 wt % to 0.005 wt %, calcium (Ca) in an amount less than or equal to 0.003 wt %, an additive in an amount of less than 0.1 wt %, balance iron (Fe), and other inevitable impurities, wherein the additive comprises at least one of titanium (Ti), niobium (Nb), and vanadium (V), wherein a tensile strength of the steel sheet after hot stamping is greater than or equal to 1,680 Mpa, bendability of the steel sheet after hot stamping is greater than or equal to 40°, and an amount of activated hydrogen in the steel sheet after hot stamping is less than or equal to 0.5 wppm, wherein an amount greater than or equal to 90% of the fine precipitates is formed to have a diameter less than or equal to 0.01 μm, wherein an amount greater than or equal to 60% of the fine precipitates are formed to have a diameter less than or equal to 0.005 μm, wherein a mean distance between the fine precipitates is greater than or equal to 0.15 μm and less than or equal to 0.4 μm.

2. The method of claim 1, wherein the forming a plating layer further comprises cooling the steel sheet on which the plating layer is formed.

3. The method of claim 1, wherein the plating bath comprises one or more elements selected from the group consisting of Si, Fe, Al, Mn, Cr, Mg, Ti, Zn, Sb, Sn, Cu, Ni, Co, In, and Bi.

* * * * *